US009506678B2

(12) United States Patent
Uselton

(10) Patent No.: US 9,506,678 B2
(45) Date of Patent: Nov. 29, 2016

(54) ACTIVE REFRIGERANT CHARGE COMPENSATION FOR REFRIGERATION AND AIR CONDITIONING SYSTEMS

(71) Applicant: Lennox Industries Inc., Richardson, TX (US)

(72) Inventor: Robert B. Uselton, Plano, TX (US)

(73) Assignee: Lennox Industries Inc., Richardson, TX (US)

( * ) Notice: Subject to any disclaimer, the term of this patent is extended or adjusted under 35 U.S.C. 154(b) by 135 days.

(21) Appl. No.: 14/316,127

(22) Filed: Jun. 26, 2014

(65) Prior Publication Data

US 2015/0377532 A1 Dec. 31, 2015

(51) Int. Cl.

*F25B 45/00* (2006.01)
*F25B 49/02* (2006.01)
*F25B 6/04* (2006.01)

(52) U.S. Cl.

CPC ..... *F25B 45/00* (2013.01); *F25B 49/02* (2013.01); *F25B 6/04* (2013.01); *F25B 2500/23* (2013.01); *F25B 2500/24* (2013.01); *F25B 2600/2523* (2013.01)

(58) Field of Classification Search

CPC ..... F25B 45/00; F25B 49/02; F25B 6/04; F25B 2500/23; F25B 2500/24; F25B 2600/2523

See application file for complete search history.

(56) References Cited

U.S. PATENT DOCUMENTS 4,484,452 A * 11/1984 Houser, Jr. ..... F25B 13/00 62/149
2003/0167792 A1* 9/2003 Cho ..... B60H 1/3204 62/500
2011/0067427 A1* 3/2011 Haller ..... B60H 1/005 62/324.6
2015/0204586 A1* 7/2015 Burg ..... F25B 30/02 62/324.6
2015/0204591 A1* 7/2015 Burg ..... F25B 49/02 62/115

OTHER PUBLICATIONS

Kim, Man-Hoe et al., "Fundamental process and system design issues in CO2 vapor compression systems", Progress in Energy and Combustion Science, Sep. 2003, pp. 119-174, vol. 30, Elsevier, Ltd.

* cited by examiner

*Primary Examiner* — Daniel Rohrhoff
(74) *Attorney, Agent, or Firm* — Bell Nunnally & Martin LLP; Craig J. Cox

(57) ABSTRACT

A variable refrigerant charge refrigeration/air conditioner system is described that allows the refrigerant charge for the system to be altered based on operating or environmental factors. The system includes a main refrigerant loop holding a volume of refrigerant corresponding to a first level of refrigerant charge, a compressor in the main refrigerant loop, a condenser in the main refrigerant loop, and an evaporator in the main refrigerant loop. A branch refrigerant loop allows the alteration of the refrigerant charge using a control valve in the branch refrigerant loop and a receiver in the branch refrigerant loop. The receiver acts to hold a volume of refrigerant when the control valve is open, thereby removing the volume of refrigerant from the main refrigerant loop. A return path from the receiver to the main refrigerant loop allows refrigerant to flow back into the main loop from the receiver.

14 Claims, 5 Drawing Sheets

ACTIVE REFRIGERANT CHARGE COMPENSATION FOR REFRIGERATION AND AIR CONDITIONING SYSTEMS

TECHNICAL FIELD

The present disclosure is directed to HVAC systems and more particularly to a system and method for adjusting the amount of refrigerant in a refrigeration/air conditioning system.

BACKGROUND OF THE INVENTION

Vapor compression air conditioning and refrigeration systems use the common refrigeration cycle to produce cooled air. A typical system 100, such as is shown in simplified form in FIG. 1, uses an electric motor to drive a compressor 102. Compressor 102 increases the pressure in a refrigerant loop 101 and pumps the refrigerant, such as R-22 (a.k.a Freon) or R-410A, under pressure to a condenser 103. Variable speed fan 104 blows air over the condenser 103 causing heat to be removed from the refrigerant. The cooled liquid refrigerant is then sent to an evaporator 106 through a thermal expansion valve (TXV) 105.

A TXV is a component in refrigeration and air conditioning systems that controls the amount of refrigerant flow into the evaporator 105 thereby controlling the heating at the outlet of the evaporator. The evaporator 106 allows the compressed cooled refrigerant to evaporate from liquid to gas while absorbing heat in the process. This state change and heat absorption cool the evaporator. Blower 107 then blows air over the chilled evaporator, thereby cooling the air which can then be forced into the desired rooms or refrigeration chambers. The low pressure, gaseous refrigerant is then returned to the compressor where it is repressurized and sent back to the condenser.

The cooling of the air by the evaporator 106 also has the effect of reducing the amount of water vapor that the air can hold. The water vapor in the air condenses thereby dehumidifying the air as well as cooling it.

In prior art systems, such as system 100, the quantity of refrigerant charge, which is the amount of refrigerant in the refrigerant loop 101, is fixed. The charge quantity used is a compromise because the optimum refrigerant charge changes with the operating mode and ambient conditions. It would be useful to provide a vapor compression refrigeration system that could change the refrigerant charge in the system to improve performance and efficiency under different operating modes and environmental conditions.

BRIEF SUMMARY OF THE INVENTION

In a preferred embodiment variable refrigerant charge refrigeration/air conditioner system is described that can change the refrigerant charge in the system based on operating or environmental factors. The variable charge system includes a main refrigerant loop that holds a volume of refrigerant corresponding to a first level of refrigerant charge. A compressor, condenser, and evaporator sit in the main refrigerant loop. A branch refrigerant loop is in fluid communication with the main refrigerant loop and includes a control valve and a receiver, where the receiver operable to hold a volume of refrigerant drawn from the main loop when the control valve is open. A return path from the receiver to the main refrigerant loop to allow refrigerant to flow back into the main loop from the receiver. This configuration allows the first level of refrigerant charge to be reduced to a second level of refrigerant charge by storing the volume of refrigerant in the receiver when the control valve is open and refrigerant in the main loop is stored in the receiver. Refrigerant in the receiver is allowed to flow back into the main loop when the valve is closed through a return path, such as a capillary tube, from the receiver back to the main loop.

In another embodiment of the variable charge refrigeration/air conditioning system, the system can be made variable between a maximum and a minimum charge by adding a level sensor and a controller. The level sensor resides in the receiver and produces a signal indicative of a level of refrigerant in the receiver. The controller receives the signal indicative of the level of refrigerant in the receiver and modulates the control valve to maintain a desired level of refrigerant in the receiver, which corresponds to the desired refrigerant charge in the main loop.

In yet another embodiment a method of controlling a variable charge refrigeration/air conditioning system is described. The method includes monitoring at least one condition associated with the system and determining a desired refrigerant charge for the system based on the at least one condition. The method then determines if a current refrigeration charge for the system is the desired refrigerant charge. If not, a control valve in the system is used to change the current refrigeration charge to the desired refrigeration charge by controlling the amount of refrigerant held in a receiver.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

As described above, an air conditioner may utilize one or more refrigerants to cool air provided to a location based on a user request for operation of the air conditioner. The amount of refrigerant included in and/or allowed to circulate in the air conditioner or portions thereof may be based at least partially on properties of the air conditioner, such as capacity of components (e.g., capacity of a condenser), type(s) of components (e.g., reheater and/or type of condenser), number of components, etc.

In various implementations of the present invention, the amount of refrigerant allowed to flow through portions of an air conditioner may be automatically adjusted based on the operation of the air conditioner. For example, changes in the ambient conditions, i.e. temperature and/or humidity may change the efficiency and performance of a refrigeration system based on a fixed refrigerant charge. It may be desirable under such conditions to change the refrigerant charge in the system between a first level and a second level where the second level of refrigerant charge is less than the first level of refrigerant. The present invention describes a system that in its various implementations alters the amount of refrigerant in the refrigerant loop based, at least partially, on operating mode and/or ambient conditions.

Preferred embodiments of a refrigeration system according to the concepts described herein provide for refrigerant charge adjustment using three primary parts. First, a receiver is provided to hold excess liquid refrigerant. Second, a valve, such as a solenoid valve, controls the flow of refrigerant into the reservoir. Third, a return path is provided to reintroduce refrigerant back into the refrigerant loop from the receiver. The return path may use a capillary tube to control the flow rate of the refrigerant back into the main refrigerant loop.

Figure 1:
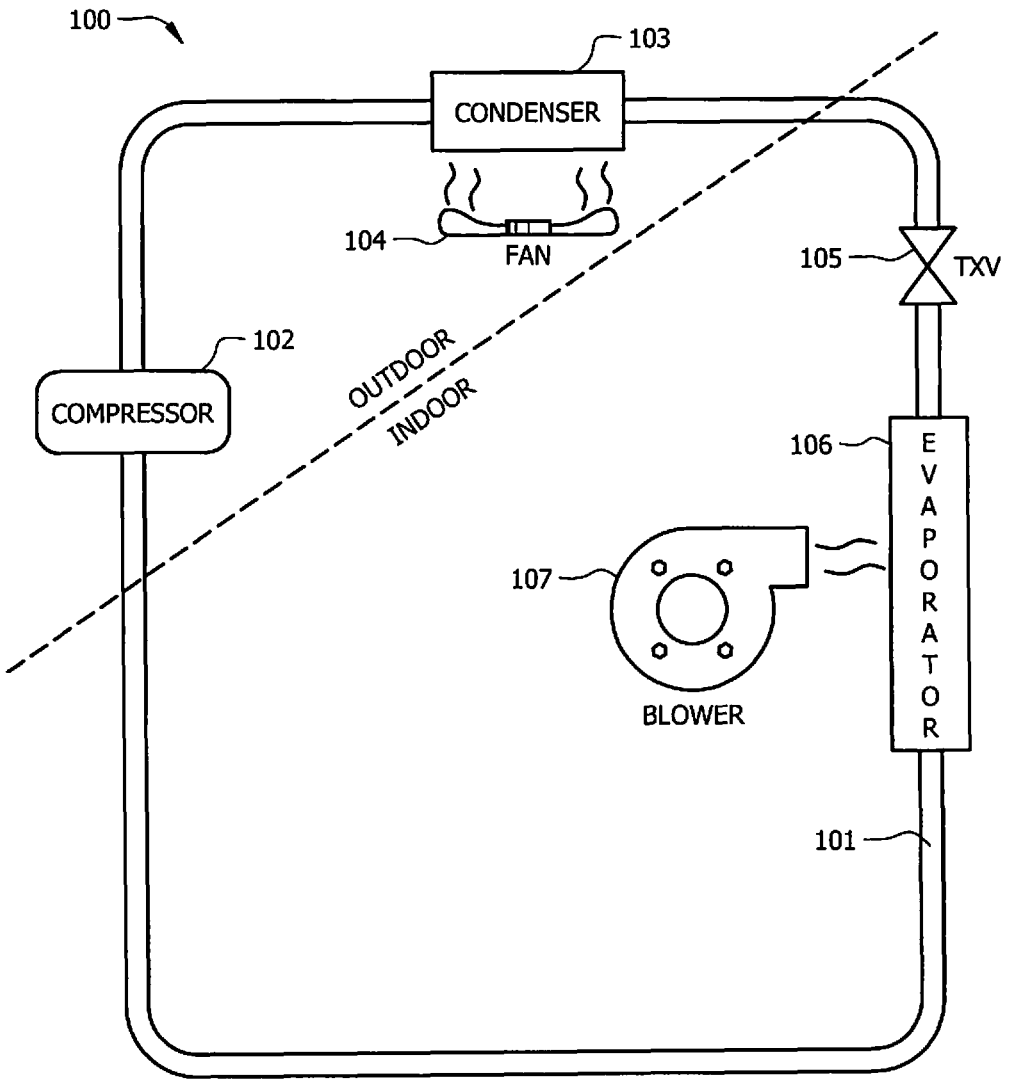
FIG. 1 (Prior Art)
FIG. 1 illustrates an implementation of a prior art air conditioning/refrigeration system.
Figure 2:
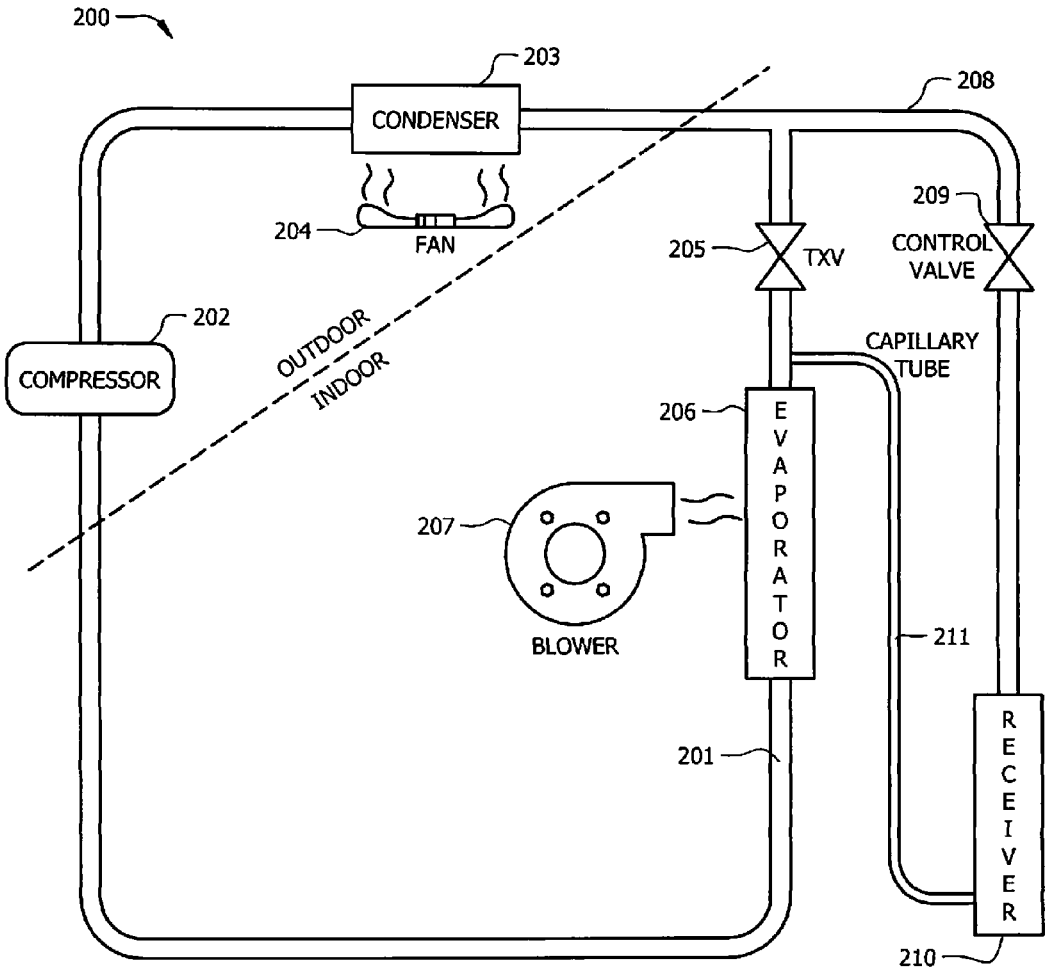
FIG. 2 illustrates a preferred embodiment of a system capable of adjusting an amount of refrigerant charge in the system.

Referring now to FIG. 2, an embodiment of an adjustable refrigeration system 200 is shown. The main refrigerant loop 201 of system 200 operates essentially as described with reference to FIG. 1. Low pressure refrigerant is pressurized by compressor 202 and sent to condenser 203. Heat is removed from the refrigerant by condenser 203 using variable speed fan 204 to move air over the condenser coils. High pressure liquid refrigerant is then passed through TXV 205 and evaporator 206 where the refrigerant is allowed to expand causing it to absorb heat and cool the surrounding evaporator. Blower 207 blows air over the cooled evaporator, thereby cooling the air, which can then be directed to a desired location.

System 200 allows the refrigerant charge to be adjusted using receiver, or reservoir, 210. Control valve 209 controls the flow of refrigerant into the receiver 210 using branch 208 from the main refrigerant loop. Capillary tube 211 provides a return path for refrigerant to flow from receiver 210 back into the main refrigerant loop 201.

When control valve 209 is closed, no refrigerant flows in branch 208 and any refrigerant in receiver 210 bleeds back into main refrigerant loop 201. In this state, system 200 operates at a first level of charge that is equivalent to a fully charged state. When control valve 209 is opened, refrigerant flows from the main refrigerant loop 201 through branch 208 and into receiver 210. The flow of refrigerant into receiver 210 from branch 208 is greater than the return flow of refrigerant through the capillary tube 211, thus after a transition period, the system will operate at a second refrigerant charge level less than the first refrigerant charge level by the capacity of receiver 210.

Therefore, when the system detects that it is operating in an overcharged state, control valve 209 can be opened and the charge can be reduced to the second charge level. If the system then detects that it is undercharged, control valve 209 can be closed allowing the refrigerant trapped in the receiver to bleed back into the main refrigerant loop returning the system to the first charge level. The body of receiver 210 should be located in a relatively warm area as, in the embodiment of FIG. 2, the capillary tube delivers refrigerant to the low pressure side of the system just after expansion valve 205.

Figure 3:
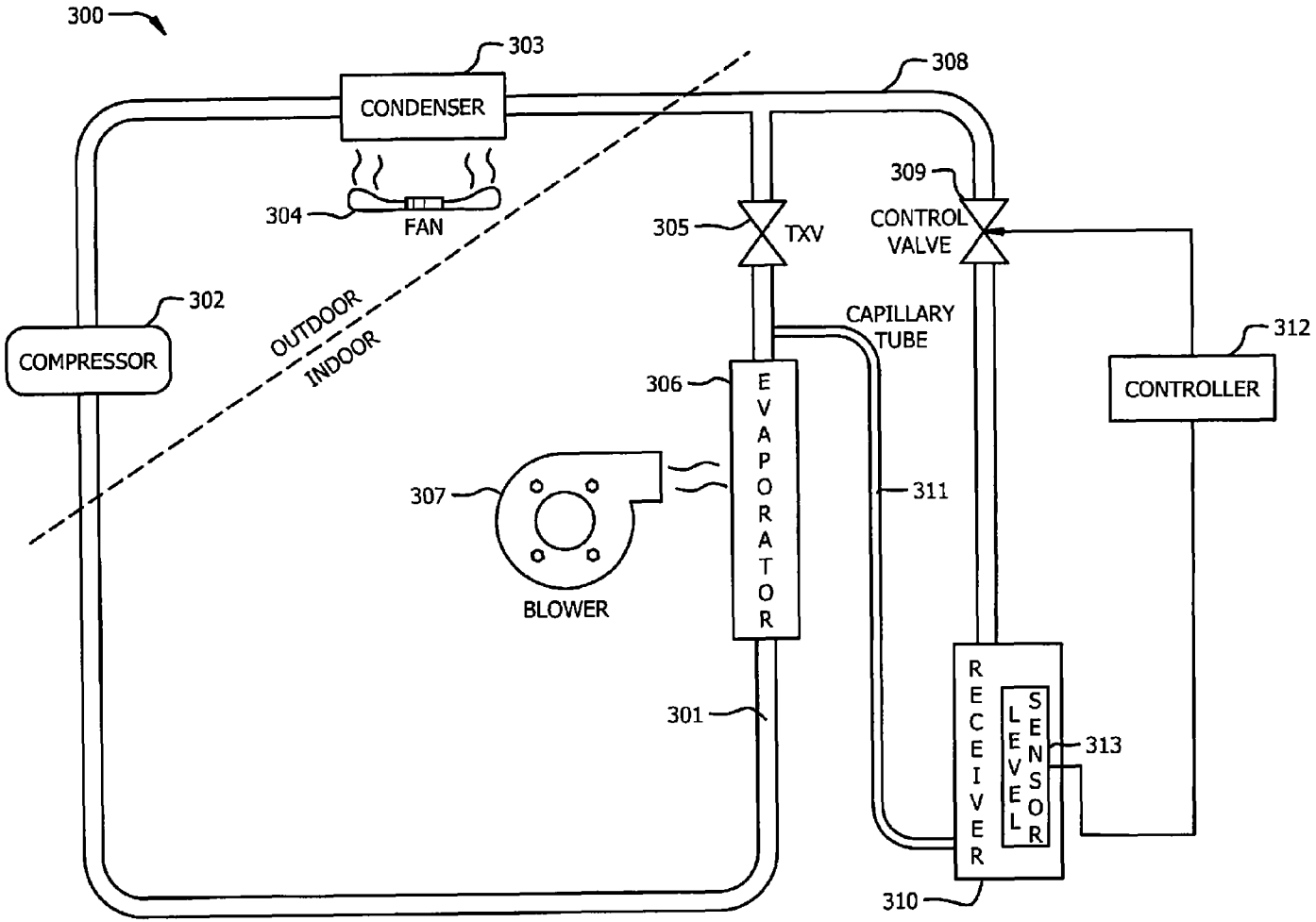
FIG. 3 is a preferred embodiment of a system capable of adjusting an amount of refrigerant charge in the system continuously between a maximum and minimum charge.

The embodiment shown in FIG. 2 allows the refrigerant charge to be adjusted between a first and second charge level. Other than a during a transition period, the system will operate at one of those two charge levels. Referring now to FIG. 3, an embodiment of a system that allows the refrigerant charge to be continuously variable between a maximum charge and a minimum charge is shown. System 300 again has main refrigerant loop 301 that passes through compressor 302, condenser 303 with variable speed fan 304, expansion valve 305 and evaporator 306 with blower 307. Branch loop 308 can again be used to direct refrigerant out of the main loop 301 and into receiver 310 under the control of valve 309. Capillary tube 311 again lets refrigerant from receiver 310 to bleed back into main loop 301.

Instead of being limited to the first charge level where the receiver is empty of refrigerant and the second charge level, where the receiver is full of refrigerant, the first and second charge levels become the maximum charge level and minimum charge level, respectively. Controller 312 and level sensor 313 allow system 300 to operate at any charge level between the maximum and minimum charge levels. Controller 312 can modulate the state of control valve 309 to maintain a desired level of refrigerant in receiver 310 as detected by level sensor 313. When level sensor 313 detects that the refrigerant level has fallen below the desired level, controller opens control valve 309 to add refrigerant to receiver 310. Conversely, when level sensor 313 detects too much refrigerant in receiver 310 for the desired operating charge level, controller 312 closes control valve 309 until the level is reduced to the desired level by the return of refrigerant from the receiver into the main loop 301 by capillary tube 311. Controller 312 may have additional inputs besides level sensor 313 and may use those inputs to help manage control valve 309. Similarly, controller 312 may have other outputs besides control valve 309.

Figure 4:
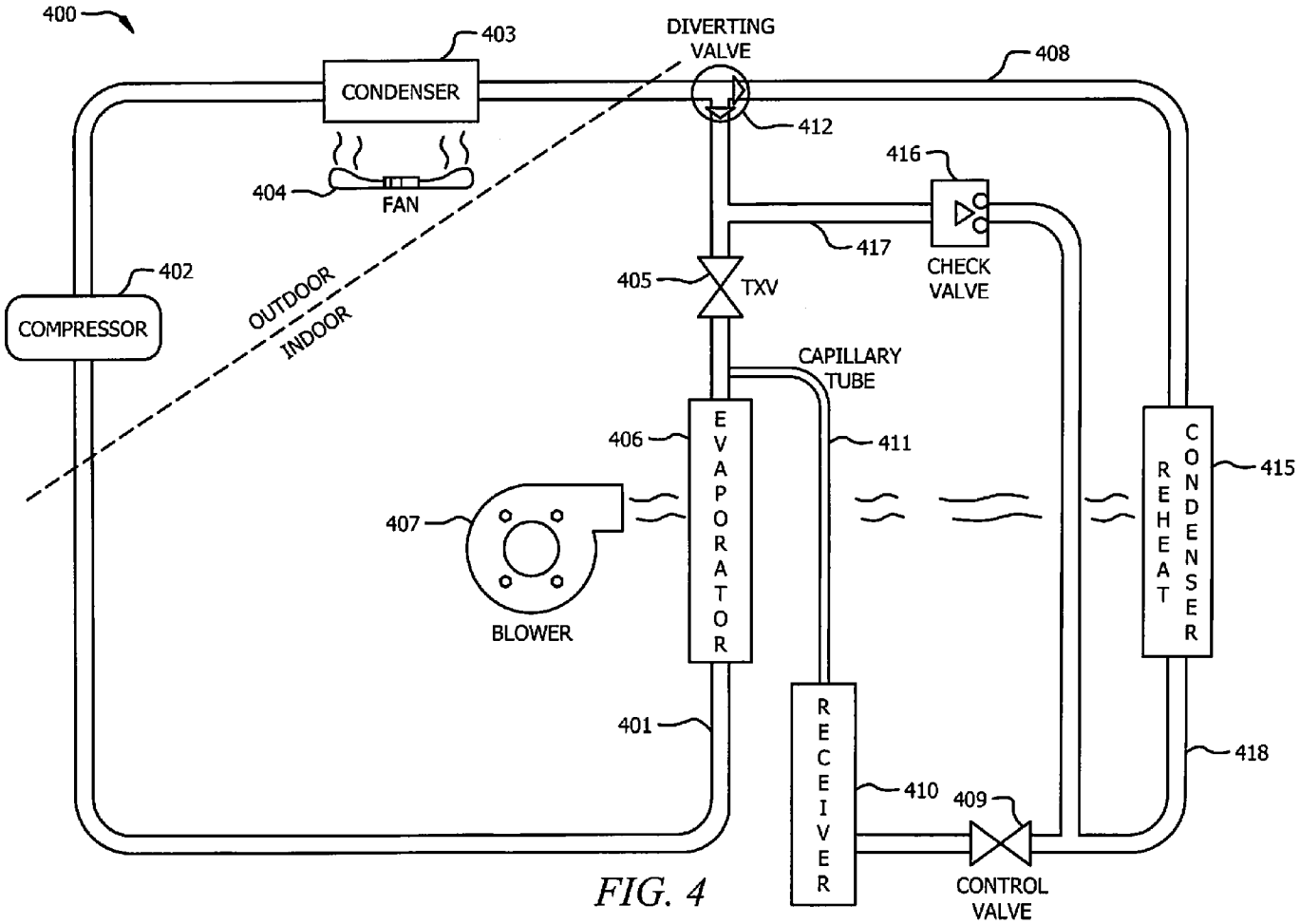
FIG. 4 illustrates a preferred embodiment of a system having two operating modes and capable of adjusting an amount of refrigerant charge in the system based on each operating mode.

Referring now to FIG. 4, an embodiment of a refrigeration system 400 that has two operating modes is shown. The presence of two distinct operating modes makes it desirable to alternate the charge in the refrigerant loop to accommodate each particular operating mode. System 400 includes a reheat condenser 415. The use of a reheater allows the refrigeration system to better control both the humidity and the temperature of the refrigerated air. For example, it may be desirable to reduce the humidity in the air using the dehumidification provided by the evaporator, but without further overcooling the building, room, or refrigeration chamber where the cooled/dehumidified air is being directed. One method of accomplishing this is to allow the evaporator to dehumidify the air as normal, but then to warm the air using a reheater.

In the first mode, system 400 operates without reheater 415 in the same way as has been described above. Main refrigerant loop 401 that passes through compressor 402, condenser 403 with variable speed fan 404, expansion valve 405 and evaporator 406 with blower 407 acting to both cool and dehumidify the air. In reheat mode, the cooled and dehumidified air exiting the evaporator is reheated. During this heat transfer interaction, a portion of the refrigerant is redirected through diverting valve 412 and into reheating branch 408. Reheating branch 408 includes reheat condenser 415 which acts to subcool the refrigerant by removing heat from the refrigerant. The air from the evaporator is then passed over the reheat condenser 415 warming it to the desired temperature. Refrigerant from the reheat condenser is passed back into the main refrigerant loop 410 through line 418, check valve 416 and line 417.

When operating the reheater, a smaller amount of refrigerant (e.g., a lower refrigerant charge) may be utilized. If the air conditioner is allowed to operate at the same refrigerant charge when the reheater is or is not in operation, the system may be overcharged when operating the reheater which may decrease efficiency, increase operation costs, or undercharged when the reheater is not in operation. To allow the system to operate at a lower charge when the reheater 415 is operating and a higher charge when it is not, embodiments of system 400 can be provided with receiver 410, control valve 409 and capillary tube 411. As has been described, opening control valve 409 removes an amount of refrigerant from the main loop 401, while closing valve 409 allows the refrigerant in receiver 410 to return to the main loop through capillary tube 411. In this manner, system 400 can operate at different charge levels based on whether or not reheater 415 is being used. While system 400 shows just one example of where it may be desirable to modify the level of refrigerant charge, many other configurations and environmental and ambient conditions exist that would benefit from the present invention and are well within the scope of the concepts described herein.

While the particular elements of a vapor compression refrigeration system have been described generally, the actual elements of the air conditioner/refrigeration system may include any appropriate components. For example, the condenser may include a microchannel condenser, a tube and fin heat exchanger, and/or other types of heat exchangers, as appropriate. A microchannel condenser includes a condenser with a channel size less than approximately 1 mm, as opposed to other types of condensers (e.g., condenser with tube size greater than 5 mm). The evaporator may include any appropriate evaporator. The receiver may include one or more containers (e.g., a vessel). In some implementations, the receiver may include one or more containers coupled in series and/or parallel. The capacity of the receiver may be selected based on properties of the air conditioner, such as the refrigerant charge specifications of the air conditioner operation during a cooling mode (e.g., the amount of refrigerant for optimum operation), refrigerant charge specifications during high temperatures, housing capacity, location space availability, standard container sizing, sizing of component(s), etc. Control valves may include a diverter valve and/or other types of multi-directional valves. In some implementations, valves may include two or more valves opened and closed in an appropriate sequence to allow the refrigerant flow in a particular line of the air conditioner. Check valves may include a check valve or other type of one-way valve, as appropriate.

In some implementations, the components of the air conditioner may be disposed in the same location (e.g., inside a building, outside a building, proximate a location in which the environment will be controlled, such as a laboratory, manufacturing facility, and/or refrigeration unit). In some implementations, a portion of the air conditioner may be disposed indoor (e.g., an indoor portion disposed inside a building) and a portion of the air conditioner may be disposed outdoor (e.g., outdoor portion disposed outside a building). For example, the indoor portion may include the receiver, the reheater, the expansion device, the evaporator, and certain valves. The outdoor portion may include the compressor, the condenser, and/or a high pressure switch. Although specific components are described as being included in an indoor portion and/or an outdoor portion, various configurations may be utilized, as appropriate.

In some implementations, the air conditioner may include more than one operating mode (e.g., a cooling operation and/or a reheat operation). The flow of refrigerant through the system and/or an amount of refrigerant in a portion of the air conditioner may be based at least partially on the operation mode. In some implementations, the air conditioner may determine whether the air conditioner is overcharged, undercharged, and/or approximately correctly charged. The air conditioner may adjust the flow of refrigerant through the system and/or the amount of refrigerant in at least a portion of the system at least partially based on this determination (e.g., reduce the amount of refrigerant allowed to flow to the evaporator when the air conditioner is overcharged.).

In some implementations, the air conditioner may include a controller that may be a programmable logic device capable of transmitting signals to valves and/or other components, such as an indoor thermostat. In some implementations, the controller may include a computer. The controller may be coupled to various components of the air conditioner and/or manage various operations of one or more of the components. The controller may include a computer and include a memory and a processor. The processor may execute instructions and manipulate data to perform operations of the controller. The processor may include a programmable logic device, a microprocessor, or any other appropriate device for manipulating information in a logical manner and the memory may include any appropriate form(s) of volatile and/or nonvolatile memory, such as RAM and/or Flash memory.

The memory may store data such as predetermined values (e.g., air conditioning specifications, such as for refrigerant charges; operating levels for refrigerant charges; predetermined ranges for conditions; default settings; criteria for determining which operation mode to allow; settings for valves in various operation modes; monitored data, such as determined conditions; and/or other data useful to the operation of the air conditioner and/or various modules of the air conditioner). Various software modules may be stored on the memory and be executable by the processor of the controller. For example, instructions, such as operating systems and/or modules such as an operation module may be stored on the memory. The operation module may manage operations and/or components (e.g., heat exchangers, valves, lines, fans, and/or compressors) of the air conditioner such as responding to requests, determining operating parameters of various components of the air conditioner, receive and/or process requests for air conditioner operations, determine components operating parameters (e.g., speeds of component operations, on/off switch settings of components, and/or valve settings), monitor conditions proximate the air conditioner, determining whether to allow a cooling operation and/or a reheat operation, determine an amount of refrigerant in at least a portion of the air conditioner, compare setpoint conditions to monitored conditions, retrieve data, determine whether the air conditioner or portions thereof are over and/or undercharged, automatically adjust valve settings, automatically adjust an amount of refrigerant, etc.

In some implementations, operation environments may affect whether the level of refrigerant in the air conditioner is overcharged, undercharged, or appropriately charged. For example, when an ambient temperature (e.g., a temperature proximate at least a portion of the air conditioner, such as the outdoor condenser) increases, the distribution of the refrigerant within the system can change, and thus a level of refrigerant (e.g., based on pressure of refrigerant) may increase in the condenser. Thus, at high ambient temperatures (e.g., when a temperature exceeds a predetermined high ambient temperature such as approximately 95 degrees Fahrenheit), the level of refrigerant may increase in the condenser and may become overcharged and thus, the air conditioner may increase the amount of refrigerant retained in the receiver as previously described.

In some implementations, a microchannel condenser may be utilized with the air conditioner. Microchannel condensers may be sensitive (e.g., due to smaller capacities than appropriate fin and tube heat exchanger) to pressure variances during operations. For example, when ambient temperatures (e.g., temperatures proximate a condenser or temperature proximate a condenser blower) are high, the pressure in the microchannel condenser may quickly become elevated due to the refrigerant-holding capacity difference between the microchannel condenser and the evaporator. The high pressures (e.g., pressures greater than approximately 615 psi) may cause mechanical failure, including prefailure events, such as excessive wear on parts. Thus, an air conditioner may monitor a level of refrigerant in the air conditioner and may adjust a level of refrigerant using the receiver based on the monitored level.

Figure 5:
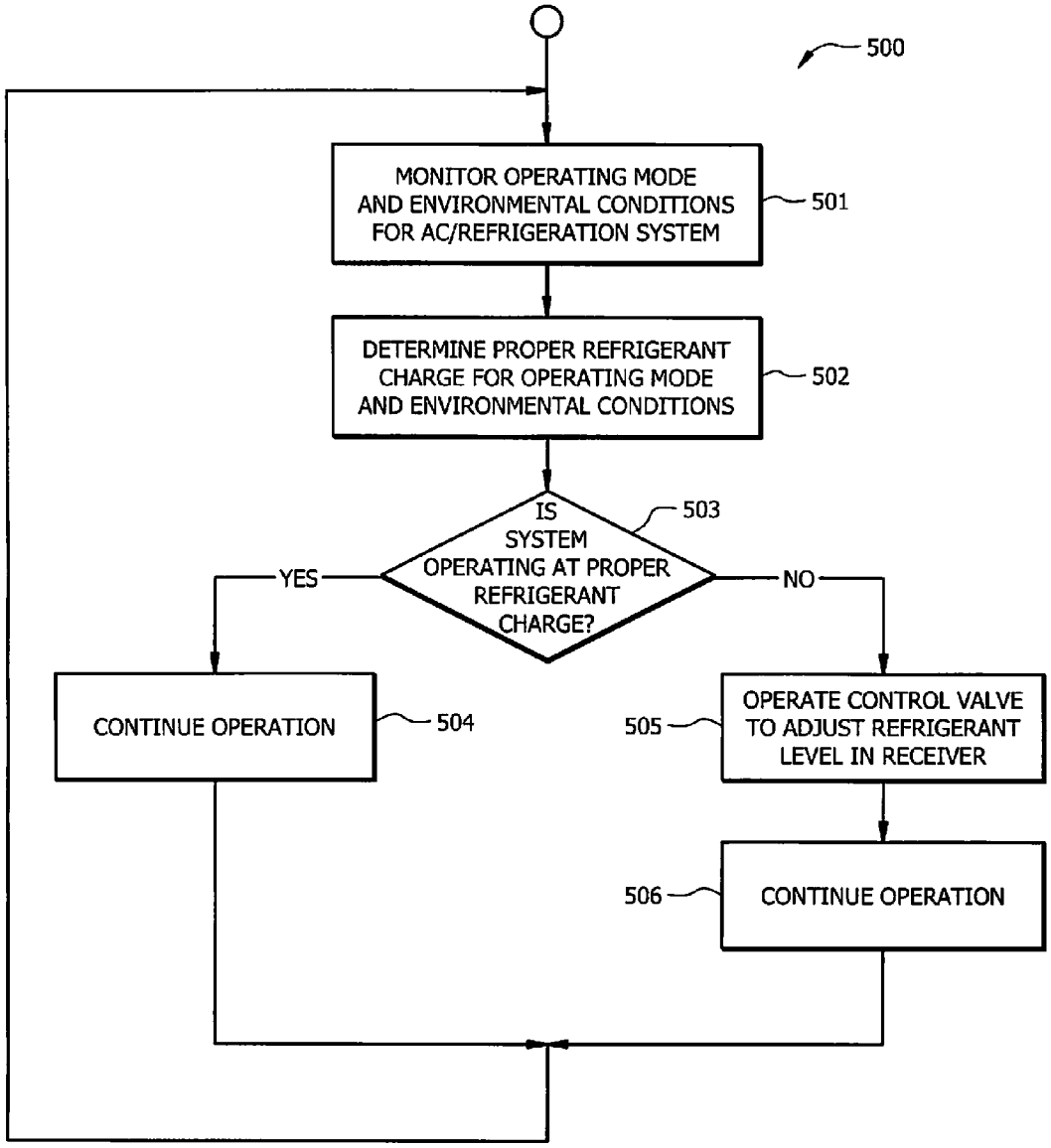
FIG. 5 illustrates a preferred embodiment of a method for adjusting the level of refrigerant charge in an air conditioning/refrigeration system.

Referring now to FIG. 5, a method for operating a refrigeration/air condition system according to the concepts described herein is shown. Method 500 begins at step 501 where the operating mode and environmental conditions for the refrigeration system are monitored. In step 502, the system determines a proper refrigerant charge level for the operating mode, environmental conditions or some combination thereof. In step 503, the system determines whether the system is currently operating at the proper refrigerant charge level. If it is, method 500 passes to step 504 where the operation of the system is continued.

If the system is not a the proper charge level as determined by step 503, then method 500 passes to step 505 where the control valve is operated to adjust the refrigerant charge level in the system. As described above with reference to FIGS. 2-4, if the charge level is too high, the control valve is opened to allow refrigerant to flow into the receiver, thereby reducing the refrigerant charge level in the main loop. If the charge level is too low, the control valve is closed allowing refrigerant to bleed back into the main loop from the receiver through the capillary tube, thereby raising the charge level in the main loop. The system could also act as described with respect to FIG. 3 and modulate the control valve to keep an intermediate level of refrigerant in the receiver as determined by a level sensor in the receiver. In this embodiment the charge level can be kept at any level between a minimum and maximum charge level. The method then passes to step 506 where the operation of the system continues at the new charge level. From steps 504 and 506 the system then passes back to step 501 where the operating mode and environmental conditions are monitored.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A variable refrigerant charge refrigeration/air conditioner system comprising:

a main refrigerant loop holding a volume of refrigerant corresponding to a first level of refrigerant charge;

a compressor in the main refrigerant loop;

a condenser in the main refrigerant loop, the condenser operable to remove heat from the refrigerant;

an evaporator in the main refrigerant loop, the evaporator receiving refrigerant from the condenser and operable to cause the refrigerant to absorb heat;

a branch refrigerant loop in fluid communication with the main refrigerant loop;

a control valve in the branch refrigerant loop;

a receiver in the branch refrigerant loop, the receiver operable to hold a volume of refrigerant drawn from the main refrigerant loop when the control valve is open; and a return path from the receiver to the main refrigerant loop;

wherein the first level of refrigerant charge is reduced to a second level of refrigerant charge by storing the volume of refrigerant in the receiver when the control valve is open.

2. The system of claim 1 wherein the return path from the receiver to the main refrigerant loop is a capillary tube through which refrigerant in the receiver flows back into the main refrigerant loop.

3. The system of claim 1 wherein the branch loop is connected to a high pressure side of the main refrigerant loop.

4. The system of claim 1 wherein the return path connects to a low pressure side of the main refrigerant loop.

5. The system of claim 1 wherein the control valve is operated based on an operating mode of the system.

6. The system of claim 1 wherein the control valve is operated based on environmental conditions for the system.

7. The system of claim 1 further comprising a thermal expansion valve in the main refrigerant loop between the condenser and the evaporator.

8. The system of claim 1 further comprising a reheater, wherein the system operates at the first level of refrigerant charge when the reheater is off and at the second level of refrigerant change with the reheater is on.

9. A variable refrigerant charge refrigeration/air conditioner system comprising:

a main refrigerant loop holding a volume of refrigerant corresponding to a maximum level of refrigerant charge;

a compressor in the main refrigerant loop;

a condenser in the main refrigerant loop, the condenser operable to remove heat from the refrigerant;

an evaporator in the main refrigerant loop, the evaporator receiving refrigerant and operable to cause the refrigerant to absorb heat;

a branch refrigerant loop in fluid communication with the main refrigerant loop;

a control valve in the branch refrigerant loop;

a receiver in the branch refrigerant loop, the receiver operable to hold a volume of refrigerant when the control valve is open, wherein the maximum level of refrigerant charge minus the volume of the receiver corresponds to a minimum level of refrigerant charge;

a return path from the receiver to the main refrigerant loop;

a level sensor in the receiver producing a signal indicative of a level of refrigerant in the receiver; and a controller receiving the signal indicative of the level of refrigerant in the receiver and operable to open and close the control valve to maintain a desired level of refrigerant in the receiver.

10. The system of claim 9 wherein the return path from the receiver to the main refrigerant loop is a capillary tube through which refrigerant in the receiver flows back into the main refrigerant loop.

11. The system of claim 9 wherein the branch loop is connected to a high pressure side of the main refrigerant loop.

12. The system of claim 9 wherein the return path connects to a low pressure side of the main refrigerant loop.

13. The system of claim 9 wherein the desired level of refrigerant in the receiver is determined based on an operating mode for the system.

14. The system of claim 9 wherein the desired level of refrigerant in the receiver is determined based on environmental conditions for the system.

* * * * *